US005380251A

United States Patent [19]

Heddon

[11] Patent Number: 5,380,251

[45] Date of Patent: Jan. 10, 1995

[54] BOWLING ALLEY BUMPER SYSTEM AND METHOD

[76] Inventor: Will Heddon, 1422 Chamberlain Loop, Lake Wales, Fla. 33853

[21] Appl. No.: 224,635

[22] Filed: Apr. 6, 1994

[51] Int. Cl.[6] ..... A63D 5/00

[52] U.S. Cl. ..... 473/109; 473/113

[58] Field of Search ..... 473/54, 55, 106, 109, 473/113

[56] References Cited

U.S. PATENT DOCUMENTS

| | | | |
|---|---|---|---|
| 694,463 | 3/1902 | Downey . | |
| 2,628,103 | 2/1953 | Parmer | 473/109 |
| 2,686,054 | 8/1954 | Coroniti | 473/109 |
| 3,401,933 | 9/1968 | Conklin et al. | 473/109 |
| 4,330,122 | 5/1982 | Sheinberg et al. | 473/109 |
| 4,420,155 | 12/1983 | Sheinberg et al. | 473/109 |
| 4,792,136 | 12/1988 | Dulisse | 473/109 |
| 4,900,024 | 2/1990 | Chandler et al. | 473/109 |
| 5,154,418 | 10/1992 | Wortman | 473/109 |
| 5,181,171 | 1/1993 | Stephens | 473/113 |
| 5,207,422 | 5/1993 | Beene | 473/54 |

*Primary Examiner*—William H. Grieb
*Attorney, Agent, or Firm*—Allen, Dyer, Doppelt, Franjola & Milbrath

[57] ABSTRACT

A bowling alley bumper system and method selectively guards against a bowling ball rolling into a gutter. A bungee cord extends along each side edge of a bowling alley lane and in a first position below the lane surface receives bowling balls rolling within a gutter and against the lane edge for protecting the edge of the lane from damage. A lifting mechanism raises the bungee cord to a position above the lane surface for receiving bowling balls rolling on the surface toward the gutter and redirecting the bowling balls towards the center of the lane and away from the gutter. The bungee cord is lifted to its second position by a plurality of elongated rods positioned to move alongside the lane below the gutter surface. A connecting rod raises and lowers the elongated rods through a lever action thereby positioning the bungee cord at its first stored position or its elevated position for guarding the gutter.

20 Claims, 2 Drawing Sheets

BOWLING ALLEY BUMPER SYSTEM AND METHOD

BACKGROUND OF INVENTION

1. Field of Invention

The invention relates generally to a bowling alley bumper system and more particularly to a system for limiting access to a gutter for a bowling ball traveling within a predetermined speed.

2. Background Art

The game of bowling has been unattractive to preteens and especially children of younger ages because they have very little control of the ball which normally rolls into the gutter before knocking down pins. Various bowling alley bumper systems have been built to keep the ball out of the gutter. Some of these systems include rails expanding out of the capping and retracting when regulation bowling is to be played. U.S. Pat. No. 5,207,422 issued to Bobby R. Beene on May 4, 1993 closes a bowling alley bumper system for guarding against throwing gutter balls. An elongated guard rail is supported alongside the gutter and can be pivotally retracted or extended between a first position in which the gutter is exposed and unguarded and a second position in which the gutter entry via bowling ball is precluded. The retractable bumper rails are extended and disposed longitudinally over gutters adjacent bed lanes so as to deflect a ball from entering the gutter.

U.S. Pat. No. 5,181,716 issued to Michael W. Stephens on Jan. 26, 1993 discloses a bowling alley bumper system which includes a bowling alley having a pair of gutters with longitudinally extending portions and extending and retracting means for moving these portions into a position which allows bowling balls to fall into or roll along one of the gutters. The bumper bowling system is incorporated into the bowling alley.

U.S. Pat. No. 4,900,024 issued to John Chandler on Feb. 13, 1990 discloses a bowling alley bumper system in which an elongated bumper is mounted alongside and parallel to each alley gutter, in which there are provided movable supports that permit the extension of the bumpers to guard the gutters when guarding is desired in retraction of the bumpers to expose the gutters when normal alley operation is desired. A plurality of elongated members are retractably mounted alongside and parallel to the access of a bowling alley, thereby providing permanent mounting while permitting extension for activation and retraction for deactivation, thus facilitating storage in use. The bumpers are mounted by projecting supports swivelably connected with swivels which provide connection to and support by guide members. The bumpers may be activated or inactivated without having to transport them to or away from the alley. Deployment of the bumpers between the active and inactive positions is accomplished by a manual swiveling movement of the bumpers or by motive power.

U.S. Pat. No. 4,792,136 issued to David Dulisse on Dec. 20, 1988, discloses a bowling alley having fluction means removably disposed longitudinally along both sides of a lane bed outside of gutters along the lane for deflecting a bowling ball rolled down the lane. The deflection means prevents the ball from falling into the gutters. Upright pin support members are provided at each end of the deflection means which extends along at least a portion of each side of the lane bed between a follow line and a pin deck. Each of the members is removably disposable at its lower end in a pin clamping means located below the lane bed in between the gutter and lane bed. Each of the deflection means is also removably supported substantially vertically above the lane bed by the pin members. The bowling alley serves as a conventional alley when the deflection means and the pin members are removed and as a carom bowling alley when the deflection means are supported in place.

U.S. Pat. No. 4,420,155 issued to Zena Sheinberg and Alex Wortman on Dec. 13, 1933 disclosed a convertible bowling alley having resilient or non-resilient deflection means removably disposed along both sides of the lane bed for preventing balls from dropping into the gutters of the bowling alley. Exemplary deflection means such as tubes, springs, and elastic bands are described being removably disposable in the gutters and conveniently storable elsewhere when removed.

Throughout the development of bowling alley bumper systems, it has been an objection to provide improvements that reside in the aesthetic enhancement of the system while reducing noise level and distraction associated with bowling alley bumper system. In addition, it has been an objective in the art to provide such bowling alley systems that are easily adaptable to existing bowling alleys.

SUMMARY OF INVENTION

A bowling alley comprises a longitudinally extending lane having side edges and a bowling lane surface extending between the edges. The lane surface has a foul line at one end and a pin deck at the other end. A pair of elongated generally concave gutters extend along and substantially abut the side edges between the ends. The gutters are positioned adjacent the lane for receiving a bowling ball which falls off the lane surface. Each gutter has longitudinal extending portions having a major axis parallel to a longitudinally extending lane axis. In the present invention, a pair of elongated resilient cords extend along each side edge in a first position below the lane surface such that each cord is positioned to receive a bowling ball rolling within the concave gutter and into the lane edge. The resilient cord thereby absorbs an impact of the ball against the edge. Means is provided for elevating the cord to a second position above the lane surface to a distance sufficient for engaging a bowling ball rolling on the surface toward the gutter and confining the ball to the surface. The elevating means has a portion extending above the lane surface for holding the cord in the elevated position. That portion is sufficiently resilient for bending when receiving a bowling ball and returning to its elevating position after interacting with the ball.

In the preferred embodiment, the elevating means comprises a plurality of elongated rods having first and second ends. The rods are positioned substantially perpendicular to the lane surface. Each rod first end is affixed to a portions of the cord at spaced distances along the cord. The rod second end is positioned below the lane surface. The rods are extendible from a first position below the lane surface wherein the cord is held in the cord first position to a second position wherein the cord is held above the lane edge for receiving a bowling ball rolled toward the gutter. The cord second position is sufficiently elevated to deflect the bowling ball away from the lane edge. In addition, means is provided for positioning the rods from the first position to the second position thereby substantially limiting the bowling ball rolling on the lane surface from dropping into a gutter adjacent the lane.

In the preferred embodiment of the present invention, the rods comprise spring rods formed from coiled spring wire. The spring rods are sufficiently flexible for bending from an original dimension when receiving a bowling ball rolled on a lane surface and returning to the original dimension after redirecting the bowling ball.

Again in the preferred embodiment, the rod positioning means comprises a base plate dimensioned to be affixed to side wall portions of the lane. The side wall portions are positioned below the gutters adjacent the lane. A guide tube is affixed to each base plate. The guide tube has an opening dimensioned to receive the elongated rod for holding the rod in a generally vertical position substantially perpendicular to the lane surface. A lever arm having first and second ends and a center portion is rotatably affixed to the base plate for pivoting about the center portion. The arm second end is rotatably affixed to the rod second end. A connecting rod is affixed to each lever arm first end. The connecting rod is connected to the lever arms and communicates between the plurality of lever arms wherein movement of the connecting rod along a direction generally parallel to the lane surface moves the spring rod from the first position to the second position.

In the preferred embodiment of the present invention, the cord comprises bungee cord sufficiently dimensioned and resilient for receiving a bowling ball rolled on the lane surface and redirecting the ball toward the lane center. In an alternate embodiment, the bungee cord is sufficiently resilient for receiving a bowling ball having a predetermined momentum while rolling on the lane surface and redirecting the ball toward the lane center while permitting a bowling ball having a greater momentum to be placed into the gutter.

It is an object of the invention to provide a bowling alley bumper system that permits simple retrofitting of the system within existing bowling alleys. It is further an object of the invention to provide a bumper system that prevents a ball from entering a gutter before knocking down pins without having to replace a gutter or gutter capping. It is yet further an object of the invention to provide such a bumper system that is retractable for permitting traditional use of the bowling alley. It is an object of the invention to provide a bumper system that can be manually positioned and raised into position should a motorized method fail. It is further an object of the invention to provide protection to side edges of a lane while storing the bumper system. It is finally an object of the invention to provide a bumper system that will permit a bowling ball to enter a gutter when the ball is rolling with a momentum exceeding a predetermined momentum.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENT

Figure 1:
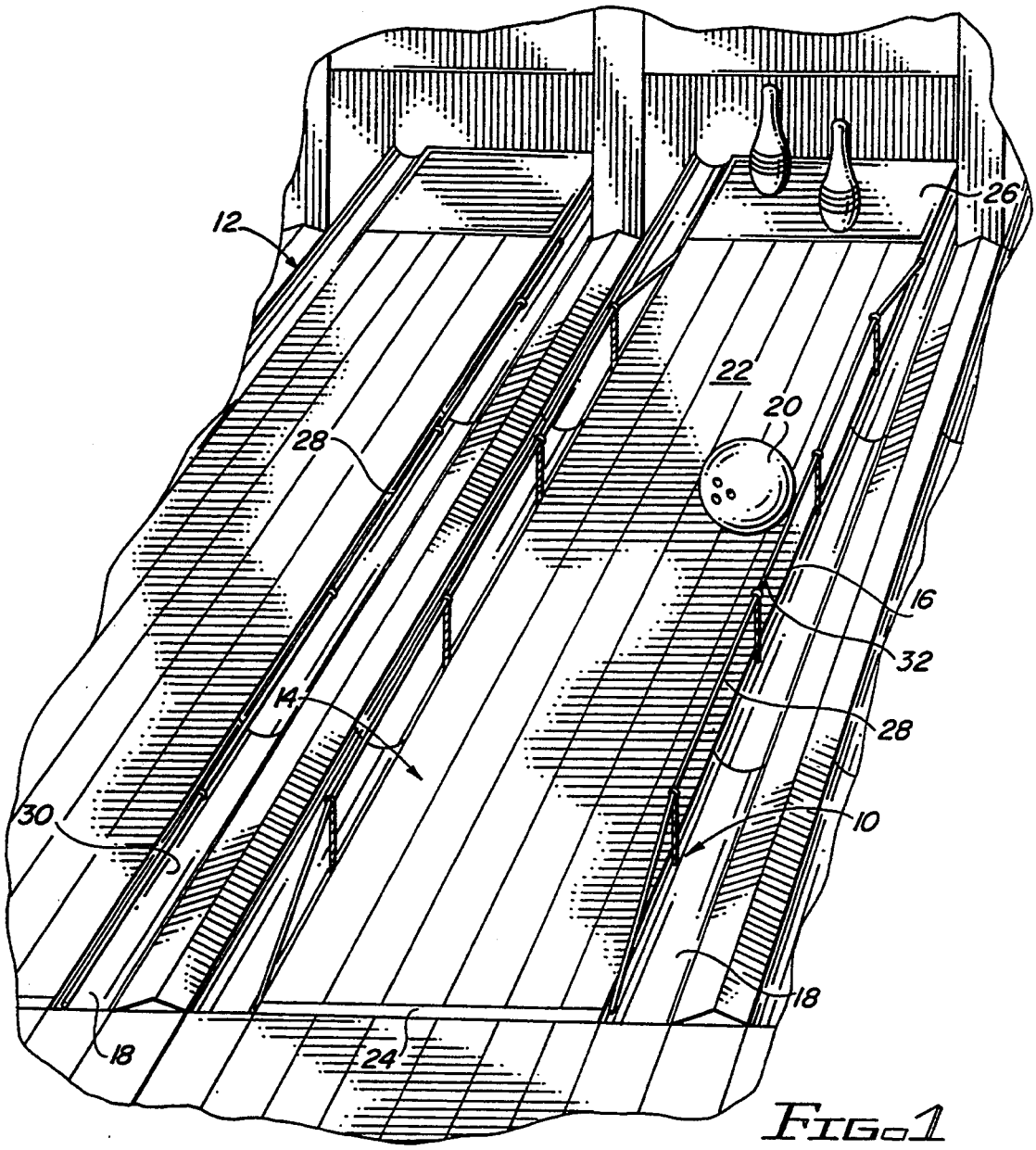
FIG. 1 is a perspective view of a bowling alley illustrating the preferred embodiment of the patent invention.

The preferred embodiment of the invention is described in connection with the accompanying drawings wherein a bowling alley bumper system 10 is illustrated in FIG. 1 with a bowling alley 12. The bowling alley 12 typically includes a longitudinally extending lane 14 having side edges 16 adjacent to which concave gutters 18 are positioned. The gutters 18 are positioned adjacent the lane 16 for receiving a bowling ball 20 which falls off the lane surface 22. Each gutter 18 has longitudinally extending portions having a major access parallel to a longitudinally extending lane access. The lane 14 has a foul line 24 at one end and a pin deck 26 at the other end. The present invention, a bowling alley bumper system 10, comprises a pair of elongated resilient cords 28 extending along each side edge 16 in a first position 30 below the lane surface 22. In such a first position, each cord 30 is positioned to receive a bowling ball rolling within the concave gutter 18 and into the lane edge 16. The cord 28 receives the bowling ball thereby absorbing the impact of the ball against the edge 16 for preventing damage to the edge 16.

Figure 2:
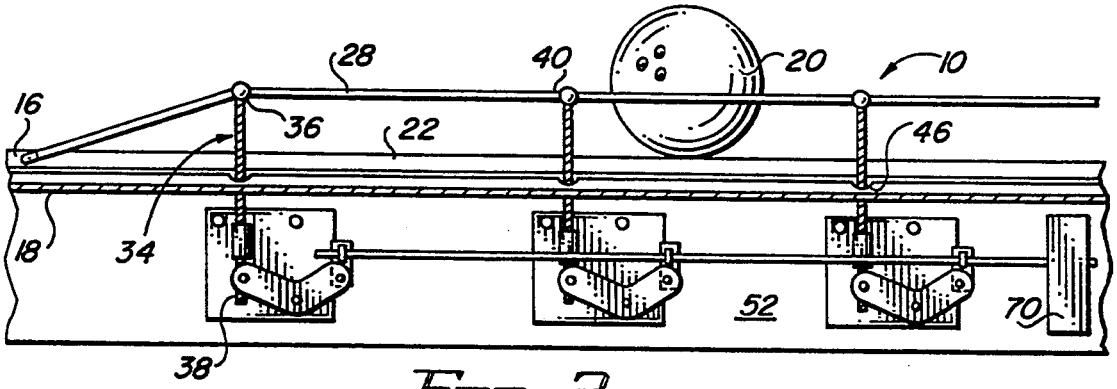
FIG. 2 is a partial cross-sectional view of a leave portion illustrating lifting mechanism used in the preferred embodiment.

As illustrated in FIG. 1 and further illustrated in FIG. 2, the cord 28 is elevated to a second position 32 above the lane surface 22 a distance sufficient for engaging the bowling ball 20 rolling on the surface 22 toward the gutter 18 thereby confining the ball 20 to the surface 22 as illustrated in FIG. 2.

Figure 3:
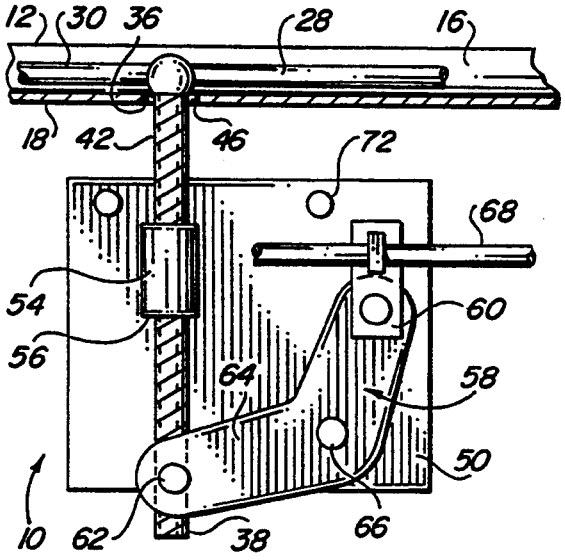
FIG. 3 is a partial side elevation view of the preferred embodiment illustrating a first position for a cord and rod.
Figure 4:
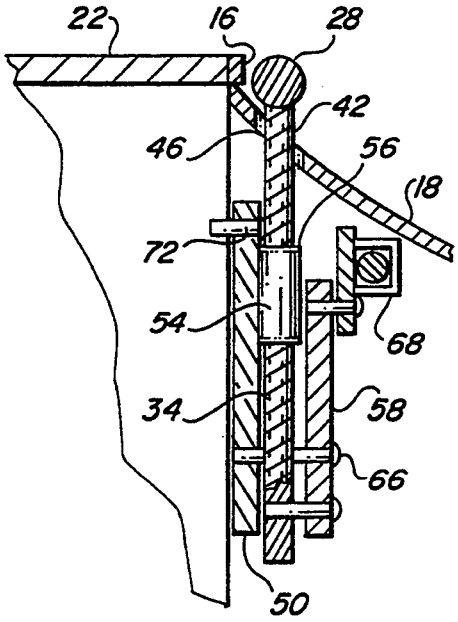
FIG. 4 is a partial end elevation view of the embodiment shown in FIG. 3.
Figure 5:
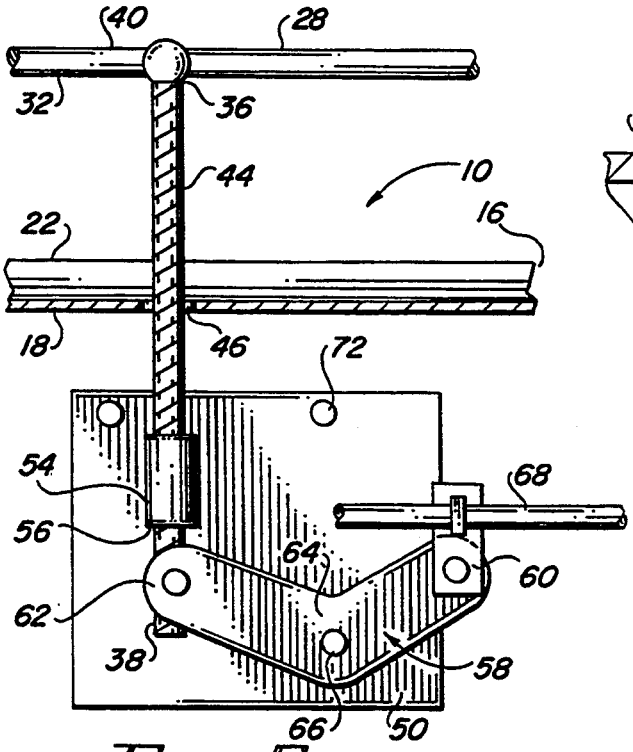
FIG. 5 is a partial slide elevation view of the preferred embodiment illustrating a second position for the cord and rod.
Figure 6:
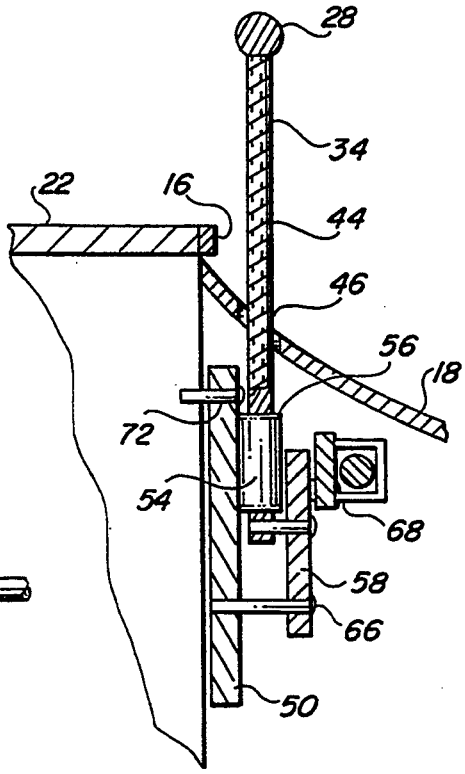
FIG. 6 is a partial end elevation view of the embodiment shown in FIG. 5.

As further illustrated in FIGS. 1 and 2, a plurality of elongated rods 34 having first and second ends 36 and 38 are positioned substantially perpindicular to the lane surface 22. Each rod first end 36 is affixed to portions 40 of the cord 28 at spaced distances along the cord 28. As further illustrated in FIG. 2 and FIGS. 3–6, the rod second end 38 is positioned below the lane surface 22 and below the gutter 18. The rods 34 are extendable from a first position 42 as illustrated in FIG. 3 and 4 to a second position 44 as illustrated in FIGS. 5 and 6.

Again with reference to FIGS. 1, 3 and 4, the cord 28 is positioned along the lane side edge 16 in the cordfirst position 30. In the preferred embodiment, the cord 28 comprises a bungee cord having one end affixed to the lane side edge 16 proximate the follow line 24 as illustrated in FIGS. 1 and 2 and another affixed to the lane side edge proximate the pin deck 26 as illustrated in FIG. 1. In the cordfirst position 30, the cord 28 biases against the lane side edge 16. In addition, the rods 34 in their first position 42 secure the cord 28 within the cordfirst position 30 as further illustrated in FIGS. 1, 3 and 4. It is anticipated that the cord 28 can be positioned proximate the lane side edges 16 and effectively protect the side edges 16 from a bowling ball rolling within the gutter 18 against the side edge.

With reference again to FIGS. 3 through 6, the rods 34 pass through openings through the gutter 18. A base plate 50 is affixed to sidewall portions 52 of the lane 14.

The sidewall portions 52 are below the gutters 18 adjacent the lane 14. The guide tube 54 is affixed to each base plate 50. The guide tube 54 has an opening 56 dimentioned to receive the elongated rod 34 for holding the rod 34 in a generally vertical position substantially perpendicular to the lane surface 22. A lever arm 58 has first and second ends 60 and 62 and a center portion 64. The center portion 64 is rotatably affixed to the base plate 50 for pivoting about the center portion. In the preferred embodiment, a simple pin and hole arrangement 66 well known in the art is used. The lever arm second end 62 is rotatably affixed to the rod second end 38. In the preferred embodiment, the elongated rod 38 comprises a flexible spring rod sufficiently flexible for bending from a vertical position when being hit by a bowling ball back to the vertical position after the ball has been redirected. A portion of the spring rod at the rod end 38 is connected to a pin 66 passing through the lever arm second end 62 in the preferred embodiment. The lever arm first end 60 is rotatably affixed to a connecting rod 68 as further illustrated in FIGS. 3 through 6. The connecting rod 68 in the preferred embodiment is a rigid rod communicating between the plurality of lever arms 58 such that movement of the connecting rod 68 generally along a direction parallel to the lane surface 22 moves the spring rods 34 from their first position 42 to their second position 44 and back as desired for use or storage.

As further illustrated with reference to FIG. 2, a motor drive mechanism 70 well known in the art, is used for providing movement to the connecting rod 68. In an alternate embodiment, a manual lever arm (not shown) is used as a back up to the motor drive mechanism 70. With such an arrangment, it is a simple matter to position the bungee cord 28 in the preferred embodiment to its first or second position 30 and 32, respectively. In the preferred embodiment, only the bungee cord 28 can be seen by a bowler on the lane 14 when the cord 28 is in its first position 30. When in its second position 32, the cord 28 and upper portions of the elongated rods 34 are seen. As described earlier, the elongated rods made of spring steel are sufficiently flexible to bend when hit by a bowling ball in return to their vertical position when extended above the lane surface 22 in their second position 44. In the preferred embodiment, the bungee cord 28 is sufficiently flexible to move from its first position 30 to its second position 32 and repel a bowling ball 20 rolling against the cord 28. In an alternate embodiment, a cord 28 is selected such that the cord 28 in its second position 32 will repel a bowling ball 20 having a predetermined momentum but will permit the bowling ball 20 to roll past the cord 28 and into the gutter 18 when its momentum exceeds that predetermined value. Except for the cord 28 and rods 34, balance of the system 10 is positioned below the gutter 18 out of sight of the bowler. In the preferred embodiment, the base plate 50 comprises holes 72 for affixing the base plate 50 to lane sidewall portions 52, as further illustrated in FIGS. 2 through 6.

While a specific embodiment of the invention has been described in detail herein above, it is to be understood that various modifications may be made from the specific details described herein without departing from the spirit and scope of the invention as set forth in the appended claims.

Having now described the invention, the construction, the operation and use of preferred embodiments thereof, and the advantageous new and useful results obtained thereby, the new and useful constructions, methods of use and reasonable mechanical equivalents thereof obvious to those skilled in the art are set forth in the appended claims.

What is claimed is:

1. A bowling alley comprising:

a longitudinally extending lane having side edges and a bowling lane surface extending between the edges, the lane surface having a foul line at one end and a pin deck at the other end thereof;

a pair of elongated generally concave gutters extending along and substantially abutting the side edges between the ends, the gutters positioned adjacent the lane for receiving a bowling ball which falls off the lane surface, each gutter having longitudinal extending portions having a major axis parallel to a longitudinally extending lane axis;

a pair of elongated resilient cords extending along each side edge in a first position below the lane surface, each cord positioned to receive a bowling ball rolling within the concave gutter and into the lane edge, the resilient cord thereby absorbing an impact of the ball against the edge; and means for elevating the cord to a second position above the lane surface a distance sufficient for engaging a bowling ball rolling on the surface toward the gutter thereby confining the ball to the surface, the elevating means having a portion extending above the lane surface for holding the cord in the elevated position, the portion sufficiently resilient for bending when receiving a bowling ball and returning to its elevating position after interacting with the ball.

2. The alley as recited in claim 1, wherein the elevating means comprises:

a plurality of elongated rods having first and second ends, the rods positioned substantially perpendicular to the lane surface, each rod first end affixed to a portions of the cord at spaced distances along the cord, the rod second end positioned below the lane surface, the rods extendible from a first position below the lane surface wherein the cord is held in the cord first position to a second position wherein the cord is held above the lane edge for receiving a bowling ball rolled toward the gutter, the cord second position sufficiently elevated to deflect the bowling ball away from the lane edge; and means for positioning the rods from the first position to the second position thereby substantially limiting the bowling ball rolling on the lane surface from dropping into a gutter adjacent the lane.

3. The alley as recited in claim 2, wherein the rods comprise spring rods formed from coiled spring wire, the spring rods sufficiently flexible for bending from an original dimension when receiving a bowling ball rolled on a lane surface and returning to the original dimension after redirecting the bowling ball.

4. The alley as recited in claim 2, wherein the rod positioning means comprises:

a base plate dimensioned to be affixed to side wall portions of the lane, the side wall portions positioned below the gutters adjacent the lane;

a guide tube affixed to each base plate, the guide tube having an opening dimensioned to receive the elongated rod for holding the rod in a generally vertical position substantially perpendicular to the lane surface;

a lever arm having first and second ends, the lever arm having a center portion rotatably affixed to the base plate for pivoting about the center portion, the arm second end rotatably affixed to the rod second end; and a connecting rod affixed to each lever arm first end, the connecting rod communicating between the plurality of lever arms, wherein movement of the connecting rod along a direction generally parallel to the lane surface moves the elongated rod from the first position to the second position.

5. The alley as recited in claim 1, wherein the cord comprises bungee cord sufficiently dimensioned and resilient for receiving a bowling ball rolled on the lane surface and redirecting the ball toward the lane center.

6. The alley as recited in claim 1, wherein the cord comprises bungee cord sufficiently dimensioned and resilient for receiving a bowling ball of a predetermined momentum rolled on the lane surface and redirecting the ball toward the lane center while permitting a bowling ball having a greater momentum to be placed into the gutter.

7. A bowling alley bumper system for guarding gutters adjacent a bowling alley lane, the bumper system comprising:

a flexible cord dimensioned for extending along a side of a bowling alley lane, the cord having a first end adapted for affixing proximate a pit area and a second end for affixing proximate a foul line, the cord sufficiently flexible for expanding from a first position along the lane side to a second position above the lane surface when receiving a bowling ball rolled on a bowling alley lane surface against the cord and for expanding when receiving the ball and thereafter contracting for redirecting the ball inward toward a center of the lane;

means for holding the cord in a first position along a side of the lane at an edge of a gutter adjacent the lane; and means for elevating the cord into a second position above the lane edge for receiving a bowling ball rolled toward the gutter, the cord second position sufficiently elevated above the lane surface for deflecting a bowling ball away from the lane edge thereby substantially limiting any bowling ball rolling on the lane surface from dropping into a gutter adjacent the lane.

8. The bumper system as recited in claim 7, wherein the holding means comprises means for affixing a cord proximal end to a portion of the lane side proximate a foul line and a cord distal end to a portion of the lane side proximate a pin deck, the affixing means dimensioned sufficiently distant each other for tensioning the cord thereby biasing the cord against the lane side.

9. The bumper system as recited in claim 7, wherein the elevating means comprises:

a plurality of elongated rods having first and second ends, the rods dimensioned for positioning substantially perpendicular to a lane surface, each rod first end affixed to a portion of the cord at spaced distances along the cord, the rod second end located for positioning below a lane surface, the rods extendible from a first position below the lane surface wherein the cord is held in the cord first position to a second position wherein the cord is held above the lane edge for receiving a bowling ball rolled toward the gutter, the cord second position sufficiently elevated for deflecting the bowling ball away from the lane edge; and means for moving the rods from the first position to the second position for limiting a bowling ball rolling on the lane surface from dropping into the gutter adjacent the lane.

10. The alley as recited in claim 9, wherein the rods are spring rods formed from coiled spring wire.

11. The alley as recited in claim 9, wherein the rod moving means comprises:

a base plate dimensioned to be affixed to side wall portions of a lane, the side wall portions positioned below gutters adjacent the lane;

a guide tube affixed to each base plate, the guide tube having an opening dimensioned to receive the elongated rod for holding the rod in a generally vertical position substantially perpendicular to a lane surface;

a lever arm having first and second ends, the lever arm having a center portion rotatably affixed to the base plate for pivoting about the center portion, the arm second end rotatably affixed to the rod second end; and a connecting rod affixed to each lever arm first end, the connecting rod communicating between the plurality of lever arms of each moving means, wherein movement of the connecting rod along a direction generally parallel to the lane surface moves the spring rod from the first position to the second position.

12. The alley as recited in claim 7, wherein the cord comprises bungee cord sufficiently dimensioned ,and resilient for receiving a bowling ball rolled on the lane surface and redirecting the ball toward the lane center.

13. The alley as recited in claim 7, wherein the cord comprises bungee cord sufficiently dimensioned and resilient for receiving a bowling ball of a predetermined momentum rolled on the lane surface and redirecting the ball toward the lane center while permitting a bowling ball having a greater momentum to be placed into the gutter.

14. A bowling alley bumper system comprising:

a base plate dimensioned for affixing to side wall portions of a bowling alley lane, the side wall portions positioned below gutters adjacent the lane;

a guide tube affixed to the base plate, the guide tube having an opening dimensioned to receive an elongated rod for holding the rod in a vertical position substantially perpendicular to a lane surface;

an elongated rod having first and second ends, the rod first end dimensioned for attaching to a portion of a cord extending along sides of the lane, the rod second end dimensioned for rotatably affixing to a lever arm end, the rod sufficiently dimensioned for extending the rod first end from a first position below the lane surface wherein the cord is held in a cord first position along the lane side to a cord second position wherein the cord is held above the lane edge for receiving a bowling ball rolled toward a gutter adjacent the lane, the cord second position sufficiently elevated to deflect a bowling ball toward a lane center and away from the gutter;

a lever arm having first and second ends, the lever arm having a center portion rotatably affixed to the base plate for pivoting about the center portion, the arm second end rotatably affixed to the rod second end; and means for rotatably affixing a connecting rod to the lever arm first end, the connecting rod for communicating between a plurality of base plate lever arms affixed along lane side wall portions, wherein movement of the connecting rod along a direction generally parallel to the lane surface moves the spring rod from the first position to the second position thereby positioning the cord from its first position to its second position.

15. The bumper system as recited in claim 14, wherein the elongated rod comprises flexible spring rod sufficiently flexible for bending from an original dimension when receiving a bowling ball rolled on a lane surface and returning to the original dimension after redirecting the bowling ball.

16. A method for guarding a bowling alley gutter from a bowling ball rolled on a lane of the bowling alley, the method comprising the steps of:

providing a resilient cord sufficiently dimensioned for extending along a side of a bowling alley lane from a position proximate a foul line to a position proximate a pin deck, the cord sufficiently resilient biasing against the lane side in a first position and expanding to a second position elevated above a lane surface for receiving a bowling ball rolled on the lane surface and redirecting the ball toward a center of the lane surface;

affixing one end of the cord onto a portion of the lane side proximate the foul line;

extending the cord along a side of the bowling alley lane below the lane surface;

affixing a second end of the cord onto a portion of the lane side proximate the pin deck for biasing the cord against the lane side;

providing elongated rods having first and second ends;

positioning a plurality of rods at spaced locations along the cord;

affixing the rod first ends to portions or the cord;

positioning the rod second ends below a gutter surface adjacent the lane side; and raising the rods from a first position wherein the cord is held against the lane side to a second position sufficiently elevated for deflecting a bowling ball rolling on the lane surface toward a center of the lane thereby guarding a gutter adjacent the lane surface.

17. The method as recited in claim 16, further comprising the steps of:

providing base plates dimensioned for affixing to side portions of the lane below a gutter surface adjacent the lane side;

affixing each base plate in spaced relation to each other to lane side portions below a gutter surface adjacent the lane;

affixing a guide tube to each base plate, the guide having an opening dimensioned for receiving the elongated rod and holding the rod in a vertical position substantially perpendicular to the lane surface;

providing a lever arm having a central portion and first and second end portions;

rotatably affixing the lever arm central portion to the base plate for pivoting about the central portion;

rotatably affixing the lever arm second end to the elongated rod second end;

providing a connecting rod sufficiently dimensioned for rotatably affixing to a plurality of lever arm first ends spaced along the lane side, the connecting rod positioned for movement generally parallel to the lane surface, the connecting rod positioned below the gutter surface;

rotatably affixing the lever arm first ends to portions of the connecting rod;

moving the connecting rod generally parallel to the lane surface for raising the elongated rod from the first position to the second position thereby positioning the cord from its first position held against the lane side to its second position sufficiently elevated above the lane surface for deflecting a bowling ball rolling on the lane surface toward a center of the lane thereby guarding the gutter.

18. The method as recited in claim 16, wherein the resilient cord comprises bungee cord sufficiently dimensioned and resilient for receiving a bowling ball rolling on the lane surface and redirecting the ball toward the lane center.

19. The method as recited in claim 16, wherein the cord comprises bungee cord sufficiently dimensioned and resilient for receiving a bowling ball rolling on the lane surface with a predetermined momentum and redirecting the ball toward the lane center while permitting a bowling ball having a greater momentum to be placed into the gutter.

20. The method as recited in claim 16, wherein the elongated rods comprise spring rods formed from coiled spring wire, the spring rods sufficiently flexible for bending from an original dimension when receiving a bowling ball rolled on a lane surface and returning to the original dimension after redirecting the bowling ball.

* * * * *